US006941761B2

(12) United States Patent
Gatecliff et al.

(10) Patent No.: US 6,941,761 B2
(45) Date of Patent: Sep. 13, 2005

(54) THERMOELECTRIC HEAT LIFTING APPLICATION

(75) Inventors: George W. Gatecliff, Saline, MI (US); William T. Horton, Manchester, MI (US)

(73) Assignee: Tecumseh Products Company, Tecumseh, MI (US)

( * ) Notice: Subject to any disclaimer, the term of this patent is extended or adjusted under 35 U.S.C. 154(b) by 0 days.

(21) Appl. No.: 10/457,190

(22) Filed: Jun. 9, 2003

(65) Prior Publication Data

US 2004/0244385 A1 Dec. 9, 2004

(51) Int. Cl.[7] ..... F25B 21/02; F25B 21/00; F25B 13/00; F25B 1/00; F25B 43/00

(52) U.S. Cl. ..... 62/3.3; 62/3.1; 62/3.2; 62/498; 62/503; 62/324.2; 62/324.6

(58) Field of Search ..... 62/3.1–3.3, 3.7, 62/324.2, 324.6, 498, 503; 417/366, 372

(56) References Cited

U.S. PATENT DOCUMENTS

| | | | | |
|---|---|---|---|---|
| 3,212,274 A | | 10/1965 | Eldus | |
| 3,817,043 A | | 6/1974 | Zoleta | |
| 4,493,939 A | | 1/1985 | Blaske et al. | |
| 4,576,009 A | * | 3/1986 | Ogushi et al. | 62/3.3 |
| 5,006,505 A | | 4/1991 | Skertic | |
| 5,180,293 A | | 1/1993 | Hartl | |
| 5,361,587 A | | 11/1994 | Hoffman | |
| 5,402,644 A | | 4/1995 | Faries, Jr. et al. | |
| 5,411,599 A | | 5/1995 | Horn et al. | |
| 5,436,467 A | | 7/1995 | Elsner et al. | |
| 5,551,240 A | | 9/1996 | Faries, Jr. et al. | |
| 5,782,106 A | | 7/1998 | Park | |
| 5,890,371 A | | 4/1999 | Rajasubramanian | |
| 5,900,071 A | | 5/1999 | Harman | |
| 5,952,728 A | | 9/1999 | Imanishi et al. | |
| 6,003,319 A | | 12/1999 | Gilley et al. | |
| 6,058,711 A | | 5/2000 | Maciaszek et al. | |
| 6,058,712 A | | 5/2000 | Rajasubramanian et al. | |
| 6,060,656 A | | 5/2000 | Dresselhaus et al. | |
| 6,107,645 A | | 8/2000 | Hidaka | |
| 6,148,635 A | | 11/2000 | Beebe et al. | |
| 6,158,225 A | | 12/2000 | Muto et al. | |
| 6,213,198 B1 | | 4/2001 | Shikata et al. | |
| 6,293,107 B1 | | 9/2001 | Kitagawa et al. | |
| 6,298,669 B1 | * | 10/2001 | Maruyama et al. | 62/3.2 |
| 6,300,150 B1 | | 10/2001 | Venkatasubramanian | |
| 6,338,251 B1 | | 1/2002 | Ghoshal | |
| 6,345,506 B1 | | 2/2002 | Kontani et al. | |
| 6,351,950 B1 | | 3/2002 | Duncan | |
| 6,385,976 B1 | | 5/2002 | Yamamura et al. | |
| 6,410,971 B1 | | 6/2002 | Otey | |
| 6,418,729 B1 | | 7/2002 | Dominguez-Alonso | |
| 6,505,468 B2 | | 1/2003 | Venkatasubramanian | |
| 2002/0073716 A1 | | 6/2002 | Melaragni | |
| 2002/0098093 A1 | | 7/2002 | Tomell et al. | |

OTHER PUBLICATIONS

Thermoelectric Powered Wristwatch, Zt–Spam, 3 pages, 1998–1999.

(Continued)

*Primary Examiner*—William Doerrler
*Assistant Examiner*—Filip Zec
(74) *Attorney, Agent, or Firm*—Baker & Daniels

(57) ABSTRACT

A compressor having a housing with a compression mechanism mounted therein. A suction fluid passageway is located in the housing through which the compression mechanism receives refrigerant fluid. A thermoelectric device is in thermal communication with refrigerant fluid substantially at suction pressure in the suction fluid passageway. The thermoelectric device receives thermal energy from the suction fluid passageway and refrigerant fluid therein with the thermal energy being transferred from the compressor assembly.

22 Claims, 1 Drawing Sheet

OTHER PUBLICATIONS

Loh, et al., Investigation into the use of Thermoelectric Devices as Heat Source for Heat Sink Characterization, unknown date.

Introduction to Thermoelectric Coding, Ferrotec America Corporation, 1998.

Peltier Device Information Directory, Steve J. Noll, 1999–2002.

Mahan, G.D., Thermionic Refrigeration, J. Appl. Phys. 76(7), 4362, 1994.

Mahan, G.D., Sofo, J.O. & Bartkowiak, M., Multilayer Thermionic Refrigerator and Generator, J. Appl. Phys. vol. 83, No. 9, 4683, 1998.

Vining, C.B., Semiconductors are cool, Nature 413, 577–578, Oct. 11, 2001.

Vining, C.B. & Mahan, G.D., The B factor in multilayer thermionic refrigeration. Journal of Applied Physics, vol. 86, No. 12, 6852–6853, 1999.

* cited by examiner

THERMOELECTRIC HEAT LIFTING APPLICATION

BACKGROUND OF THE INVENTION

The present invention relates to hermetic refrigerant compressors, and more particularly to the application of thermoelectric devices in a compressor.

In general, a hermetic compressor may be part of a refrigeration, heat pump, or air conditioning system including a condenser, expansion device, and evaporator. The compressor includes a housing in which a motor and compression mechanism are mounted. The motor and compression mechanism are operatively coupled by a drive shaft which is driven by the motor to operate the compression mechanism. Suction pressure gas received from the refrigeration system is drawn into the compression mechanism and is compressed to a higher, discharge pressure before being returned to the refrigeration system.

The high pressure discharge gas exiting the compressor enters the condenser where it is cooled and condensed to a liquid. The high pressure liquid passes through an expansion device which reduces the pressure of the refrigerant. The low temperature refrigerant liquid then enters the evaporator. During the evaporation process, heat is transferred from the area being cooled, such as a refrigerator or building, to the liquid in the evaporator, the temperature of which increases and returns to a vapor or gas. The low pressure suction gas enters the compressor from the evaporator and is again compressed.

Heat present in the compressor can have an adverse effect on the efficiency of the compressor, particularly heat transferred to suction pressure gas flowing toward the compression mechanism. If the temperature of the suction pressure gas is too high, the efficiency of the compressor may be reduced. It is therefore desirable to remove heat from the suction pressure gas to improve compressor efficiency.

Thermoelectric devices are well known in the art as being used to remove heat from a surface on which the device is mounted. In one previous application disclosed in U.S. Pat. No. 5,180,293 to Hartl, a plurality of thermoelectric elements are mounted to opposite sides of a heat exchanger. A heat sink is mounted to the thermoelectric elements to dissipate heat pulled from the heat exchanger, and fluid in the heat exchanger, by the thermoelectric elements prior to the fluid being pumped.

A problem with cooling the suction pressure gas at the heat exchanger prior to pumping is that the heat in the thermoelectric device must be dissipated which may require fins, for example, being mounted to the heat exchanger, thus increasing the size and amount of space required by the refrigeration system. The thermoelectric elements are also mounted to an external surface of the heat exchanger which also increases the amount of space occupied thereby.

It is desired that the present invention provide a thermoelectric device for removing heat from the suction pressure gas once the gas has entered the compressor to improve efficiency of the compressor while not increasing the amount of space required by the refrigeration system.

SUMMARY OF THE INVENTION

The present invention addresses the above-mentioned concerns with the compressor efficiency and provides a compressor having the above-mentioned desirable characteristics. In certain embodiments of the present invention, a powered thermoelectric device (TED) which acts as a heat sink or thermoelectric cooler is provided in a hermetic refrigerant compressor and is placed in contact with a surface desired to be cooled. For example, attaching the TED to the surface of a conduit through which suction pressure gas flows will cool the wall of the conduit, and thus the gas flowing therethrough. Alternatively, embedding a TED in the cylinder head of a reciprocating piston compressor between suction and discharge plenums will transfer heat from the suction pressure gas in the suction plenum to the discharge pressure gas in the discharge plenum. The TED may be in the form of a "thin-film" TED.

In one embodiment, the TED may operate under the Peltier effect in which the TED is supplied with an electrical current which flows through the TED. The TED may be used to transfer heat from suction pressure gas in the suction plenum and to the discharge pressure gas in the discharge plenum, thus improving compressor efficiency. The TED is embedded in wall separating the suction and discharge plenums. A cold side of the TED is mounted facing the suction plenum and a hot side of the TED is mounted facing the discharge plenum. Heat in the suction pressure gas is extracted therefrom by the cold side of the TED and is transferred to the TED hot side from which the heat is transferred into the discharge pressure gas passing through the discharge plenum.

Alternatively, the TED may convert thermal energy it conductively receives from the surface on which it is mounted to electrical energy, thereby acting as a thermoelectric generator (TEG) operating under the Seebeck effect. The generated electrical energy is transferred to the resistor and the resistive heat dissipated through the compressor housing. In this embodiment, the TED may be used to remove heat from the surface of a suction tube or muffler, thereby promoting cooling of the suction gas to be compressed and improving compressor efficiency. Heat is absorbed by the TED and converted into electrical energy which is transferred electrically to a resistor which may be mounted to the interior surface of the compressor housing. The heat generated by the resistor is transferred conductively to the compressor housing and is then removed therefrom by natural convection externally of the housing.

Certain embodiments of the present invention provide a compressor assembly having a housing with a compression mechanism disposed therein. The compression mechanism receives refrigerant fluid substantially at suction pressure through a suction fluid passageway located in the housing. A thermoelectric device is in thermal communication with the suction fluid passageway. The thermoelectric device receives thermal energy from the suction fluid passageway and refrigerant fluid therein with the thermal energy being transferred from the compressor assembly.

Certain embodiments of the present invention further provide a compressor assembly including a housing in which a compression mechanism is disposed. The compression mechanism has a cylinder head which has suction plenum and a discharge plenum defined therein. A thermoelectric device is mounted in thermal communication with the refrigerant fluid in the suction plenum and the discharge plenum. The thermoelectric device is provided with electrical power and conductively receives thermal energy from the suction plenum, the thermal energy being transferred to refrigerant in the discharge plenum by convection.

Certain embodiments of the present invention also provide a compressor assembly including a thermally conductive housing having a compression mechanism disposed therein. A fluid conduit is located in the housing, the compression mechanism receives refrigerant fluid through the fluid conduit. A thermoelectric device mounted to the fluid conduit in thermal communication with the refrigerant fluid in the fluid conduit. The device receives thermal energy from the conduit which is converted by the device into electrical energy. A resistor is electrically connected to the thermoelectric device being thermally connected with the housing. Electrical energy received by the resistor from the thermoelectric device is transferred to the housing with the thermal energy in the refrigerant fluid being transferred to the fluid conduit by convection, and conductively removed from the fluid conduit by the thermoelectric device. The electrical energy generated by the device is electrically transferred to the resistor, and thermal energy generated by the resistor is conductively transferred to the inside of housing, conducted through the housing, and removed from the outside of the housing by convection.

BRIEF DESCRIPTION OF THE DRAWINGS

The above-mentioned advantages, and other features and objects of this invention, and the manner of attaining them, will become more apparent and the invention itself will be better understood by reference to the following description of embodiments of the invention taken in conjunction with the accompanying drawings, wherein.

Figure 1:
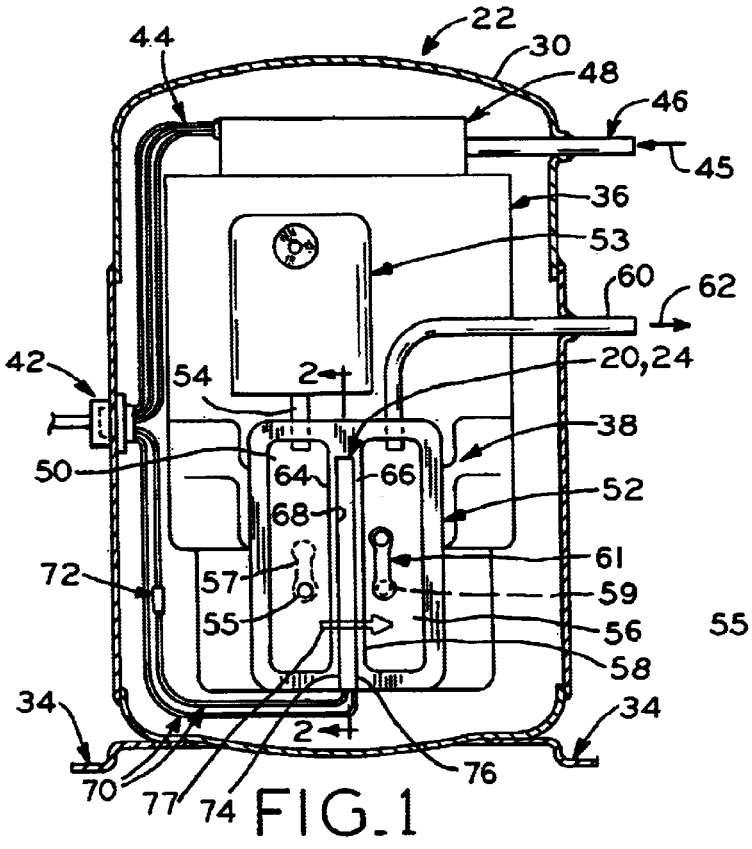
FIG. 1 is a partial sectional view of a compressor illustrating a first embodiment of the present invention.

Corresponding reference characters indicate corresponding parts throughout the several views. Although the drawings represent embodiments of the present invention, the drawings are not necessarily to scale and certain features may be exaggerated in order to better illustrate and explain the present invention.

DETAILED DESCRIPTION OF THE INVENTION

Referring to the figures, thermoelectric device (TED) 20 is mounted in a hermetic refrigerant compressor 22 to remove heat from suction pressure gas prior to compression thereof. As is well known in the art, a TED acts as a heat sink or a thermoelectric cooler to remove heat from one surface and transfer it to another surface. By mounting TED 20 in a compressor, heat can be transferred from suction pressure refrigerant in a suction conduit or plenum where high temperatures are undesirable. The compressor efficiency may be improved as heat is removed from the suction pressure gas to be compressed.

TED 20 may be in the form of a thin film such as is described in U.S. Pat. Nos. 6,300,150 and 6,505,468 to Venkatasubramanian, the disclosures of which are hereby expressly incorporated herein by reference. The thin film TED is mounted to the conduit or plenum surface using any suitable method, such as by clamping or adhesion.

TED 20 may operate under the Peltier or Seebeck effect. Referring to FIG. 1, operating under the Peltier effect, TED 24 is electrically powered, absorbing heat energy from one surface and transferring the heat to a second surface as electrical current passes therethrough. The TED is constructed from two dissimilar semiconductors joined to form a closed circuit. According to the Peliter effect, as electrical current flows through the circuit from the first type of semiconductor to the second type of semiconductor, the electrical current creates a temperature gradient across the TED when thermal energy is absorbed at a first, or cold junction of the semiconductors. The heat energy is transported through the semiconductors and is discharged at a second, or hot, junction of the semiconductors.

TED 24 has a cold side in contact with the surface from which heat is being drawn. As the electrical current passes through electrically powered or active TED 24, heat is drawn from that surface in contact with the TED, cooling the surface. The heat is transferred to a hot side of TED 24 from which it is dissipated using any suitable method, Electrically powered or active TED 24 requires a small amount of electrical current to operate. The current may be supplied by any suitable method including a battery mounted in the compressor, or the terminal assembly of the compressor as shown. This type of TED may be used in any number of location including being embedded in the cylinder head of a reciprocating piston compressor between a suction and discharge plenum, for example. TED 24 is in contact with the surface of a wall portion defining the suction plenum and the surface of a wall portion defining the discharge plenum. Heat in the suction plenum wall portion, and thus the suction pressure refrigerant located in the plenum, is transferred to one side of the TED, cooling the wall portion surface and thus the refrigerant. The heat energy is then transferred to the opposite side of TED 24, the discharge plenum wall portion, and the discharge pressure gas located in the discharge plenum.

Alternatively, TED 20 may operate under the Seebeck effect. In this case, TED 28 (FIG. 3) is passive, converting thermal energy conductively received from the surface on which the TED is mounted to electrical energy with the TED acting as a thermoelectric generator or TEG. The TEG is constructed similarly to the TED discussed above having two dissimilar semiconductors assembled to form a cold and hot junction. According to the Seebeck effect, electrical current flows continuously in a closed circuit formed from dissimilar metals providing the junctions of the metals are maintained at different temperatures.

Figure 3:
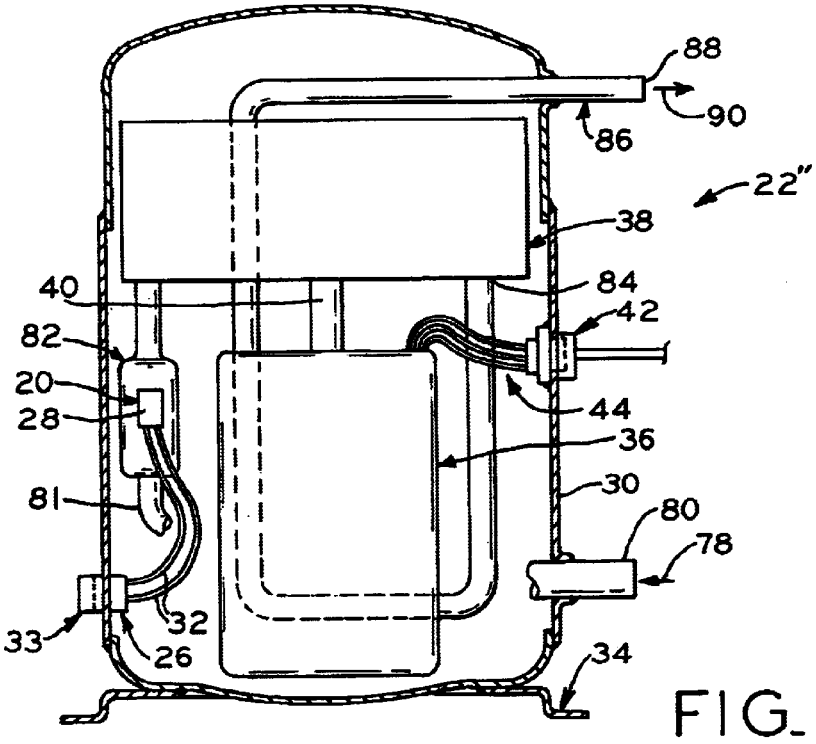
FIG. 3 is a sectional view of a compressor illustrating a second embodiment of the present invention.

Referring to FIG. 3, the energy used to drive passive TEG 28 is the heat from the mounting surface, or suction conduit, thereby eliminating the need for a supply of electrical current to the TED. By drawing heat from the mounting surface to operate passive TEG 28, the conduit surface and thus the refrigerant flowing through the conduit is cooled. The electrical energy generated by passive TEG 28 from the captured thermal energy is electrically transferred to resistor 26.

Resistor 26 is illustrated in FIG. 3 as being mounted to the interior surface of compressor housing 30. The heat drawn from the suction conduit, and thus the refrigerant flowing therethrough, by passive TEG 28 is electrically transferred to resistor 26 via wires 32 so that the heat may be dissipated from compressor 22. Resistor 26 is mounted to the interior surface of compressor housing 30 by any suitable method including adhesive, clamping, fastening, or the like, which places the resistor in conductive contact with the housing. As air moves around the compressor, the heat in compressor housing 30 is dissipated by natural convection. Heat sink or fins 33 may be mounted to the outer surface of compressor housing 30 in alignment with resistor 26 to facilitate convective transfer from the housing. Heat in housing 30 is conductively transferred to heat sink 33 and then transferred by convection to the air surrounding compressor 22.

TED 20 may be adapted for use in any suitable hermetic compressor such as, for example, the compressor described in U.S. patent application Ser. No. 09/994,236 to Tomell et al., published on Jul. 25, 2002, the disclosure of which is hereby expressly incorporated herein by reference.

TED 20 is shown in a specific application being mounted in hermetic compressor 22 (FIGS. 1 and 3). Compressor 22 is illustrated as being supported in a substantially vertical orientation by mounting feet 34, however, compressor 22 may also be oriented in a substantially horizontal position. Compressor 22 includes thermally conductive housing 30 in which motor 36 and compression mechanism 38 are mounted. Motor 36 and compression mechanism 38 are operatively coupled by drive shaft 40 (FIG. 3). Compression mechanism 38 may be of any suitable type known in the art including a scroll, reciprocating piston, or rotary type compression mechanism.

Motor 36 includes a stator having stator windings and a rotor. As is typical, electrical current is directed from an external power source (not shown) through terminal assembly 42 mounted in housing 30. Terminal assembly 42 is electrically connected to the stator windings by wires 44 and when energized, electromagnetically induces rotation of the rotor. Rotation of the rotor drives drive shaft 40 and thus compression mechanism 38.

Figure 2:
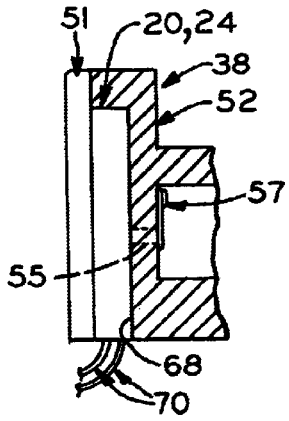
FIG. 2 is a partial sectional view of FIG. 1 taken along line 2—2.

Referring to a first embodiment shown in FIGS. 1 and 2, compressor 22' is a reciprocating piston compressor. Suction pressure gas is drawn into compressor housing 30 in the direction of arrow 45, through suction conduit 46 leading into motor end cap 48. The suction pressure gas enters compressor housing 30 and end cap 48, flowing over motor 36, to cool the motor. Heat generated during operation of motor 36 is transferred by convection to the suction pressure gas. The suction pressure gas enters cylinder head 52 of compression mechanism 38. Cylinder head 52 has suction plenum 50 and discharge plenum 56 defined therein being separated by wall 58. Cover 51 (FIG. 2), which has been removed from FIG. 1 for illustration purposes, encloses cylinder head 52 and may be secured to cylinder head 52 using any suitable method including fasteners such as bolts. Further, cover 51 may be integrally formed with cylinder head 52. The suction pressure gas first enters suction plenum 50 formed in cylinder head 52 via suction muffler 53 and suction conduit 54. The suction pressure gas exits plenum 50 through outlet port 55 operable by valve 57 (FIG. 2) to be compressed in compression mechanism 38 to a substantially higher, discharge pressure. The discharge pressure gas enters discharge plenum 56 also formed in cylinder head 52 through inlet port 59 operable by valve 61. The discharge pressure gas exits cylinder head 52 via discharge conduit 60 in the direction of arrow 62 and returns to the refrigeration system.

In the embodiment shown in FIGS. 1 and 2, electrically powered, or active TED 24 is embedded in separating wall 58 of cylinder head 52 with TED 24 defining suction plenum wall portion 64 and discharge plenum wall portion 66. Cylinder head 52 may be formed by any conventional method including casting, or the like from a material, such as cast iron, able to withstand the pressures created during compressor operation. Slot 68 is formed in cylinder head 52 to receive TED 24 which may be mounted therein by an interference fit, for example. Thermally conductive adhesives, epoxies, grease, or the like may be used between interfacing surfaces of TED 24 and wall portions 64 and 66 to improve conductivity and/or help secure TED 24 in place. Slot 68 and thus TED 24 are dimensioned to extend the width of suction and discharge plenums 50 and 56 which increases the heat transfer therebetween. TED 24 is illustrated as being electrically connected to terminal assembly 42 via wires 70 to receive electrical power from the external power supply which electrically activates both motor 36 and TED 24. However, TED 24 is operated by DC power, therefore, diode or rectifier 72 is located along wires 70 to convert AC power from the external power source to DC power. Alternatively, TED 24 may be battery operated, eliminating the connection with terminal assembly 42 and rectifier 72. The electrical power required by TED 24 is less than that of motor 36, and therefore a power control device of any suitable type familiar to one of ordinary skill in the art may also be provided between the terminal body and the TED.

TED 24 has cold side 74 in contact with suction plenum wall portion 64 and hot side 76 in contact with discharge plenum wall portion 66 such that heat from suction plenum 50 is transferred to discharge plenum 56 in the direction of arrow 77. The electrical power activates TED 24 to absorb heat from the suction pressure refrigerant gas, such as the heat transferred thereto from motor 36, and conductively transfer the heat through suction plenum wall portion 64 to cold side 74 of TED 24. Operation of TED 24 causes the heat to be transferred to hot side 76 of TED 24 as described above and to discharge plenum wall portion 66 by conduction with the temperature of hot side 76 being greater than that of wall portion 66. As discharge pressure gas flows through discharge plenum 56, the heat is transferred by convection to the discharge pressure gas being exhausted from compressor 22'.

Referring to a second embodiment shown in FIG. 3, compressor 22" may be a scroll or rotary compressor, for example. Refrigerant substantially at suction pressure is drawn into compressor housing 30 in the direction of arrow 78 through suction tube 80 mounted in housing 30 by any suitable method including welding, brazing, or the like. Suction conduit 81 is open to the interior of housing 30, and draws refrigerant at substantially suction pressure therefrom to convey it to the inlet of compression mechanism 38. Conduit 81 may be provided with suction muffler 82 to reduce the amount of noise produced during compressor operation. TED 20 is illustrated as being mounted on suction muffler 82, however, the TED may be mounted on suction conduit 81 at any location to remove heat from suction pressure gas entering the compression mechanism. The suction pressure gas is compressed in compression mechanism 38 to a substantially higher, discharge pressure which is exhausted from compression mechanism 38 into end 84 of shock tube or discharge conduit 86. A discharge muffler (not shown) may be located along discharge conduit 86 to further reduce undesirable noise produced during compressor operation. The opposite end 88 of discharge conduit 86 is mounted in compressor housing 30 by welding, brazing, or the like. Compressed refrigerant gas exits end 88 of discharge conduit 86 in the direction of arrow 90 and returns to the refrigeration system.

Referring to the embodiment shown in FIG. 3, TED 20 is passive and acts as TEG 28 discussed above. Thermal energy from suction conduit muffler 82 is conductively transferred to TEG 28 to drive the thermoelectric device and generate electrical energy, rather than being supplied with the electrical connection of the first embodiment between TED 20 and terminal assembly 42. TEG 28 converts the thermal energy to electrical energy which is conducted to resistor 26 through wires 32. The heat generated by resistor 26 is conducted to the wall of the compressor housing and dissipated from compressor 22".

As described above, resistor 26 is mounted to the interior surface of compressor housing 30. The heat transferred from resistor 26 flows into compressor housing 30 by conduction with air surrounding compressor 22" lifting the heat therefrom by natural convection, thus enhancing heat flow through compressor 22". Finned heat sink 33 may be mounted to the outer surface of housing 30 to facilitate the transfer of heat from the housing.

Compressor 22 described above and illustrated in FIGS. 1 and 3 is a low-side compressor. A low-side compressor is one in which suction pressure gas surrounds and cools the motor. The suction pressure gas in the housing is drawn into the compression mechanism through a suction conduit and/or suction plenum. The suction pressure gas is compressed with the discharge pressure gas exiting the compressor through a discharge conduit and/or discharge plenum. The TED of the present invention may also be adapted for use in a high-side compressor in which the motor is surrounded by substantially by discharge pressure gas. For example, suction pressure gas is drawn directly into the compression mechanism through a suction conduit to which the TED may be mounted to remove heat from the suction pressure refrigerant flowing therethrough in the same manner described above.

Further, TED 20 does not have to be mounted only to a suction conduit or between the suction and discharge plenums. TED 20 may be located in a hermetic compressor housing at any location where heat removal is desired.

While this invention has been described as having exemplary designs, the present invention may be further modified within the scope of this disclosure. This application is therefor intended to cover any variations, uses, or adaptations of the invention using its general principles. Further, this application is intended to cover such departures from the present disclosure as come within known or customary practice in the art to which this invention pertains.

What is claimed is:

1. A compressor assembly, comprising:

a housing;

a compression mechanism disposed in said housing;

a suction fluid passageway located in said housing, said compression mechanism receiving refrigerant fluid substantially at suction pressure via said suction fluid passageway; and a thermoelectric device in thermal communication with said suction fluid passageway, said thermoelectric device receiving thermal energy from said suction fluid passageway and refrigerant fluid therein, whereby said thermal energy is transferred from the compressor assembly.

2. The compressor assembly of claim 1, wherein said suction fluid passageway includes a first suction conduit, a motor, and a second suction conduit, said first suction conduit in fluid communication with said motor, said refrigerant fluid flowing over said motor, said motor in fluid communication with said second suction conduit.

3. The compressor assembly of claim 2, wherein said compression mechanism further includes a suction plenum and a discharge plenum defined therein, said second suction conduit in fluid communication with said suction plenum, said thermoelectric device mounted in thermal communication with the refrigerant fluid in said suction plenum and said discharge plenum.

4. The compressor assembly of claim 3, wherein said thermoelectric device is provided with electrical power, said device conductively receiving thermal energy from said suction plenum, whereby the thermal energy is transferred to refrigerant in said discharge plenum by convection.

5. The compressor assembly of claim 3, wherein said compression mechanism further includes a cylinder head, said suction and discharge plenum are formed in said cylinder head, a wall formed in said cylinder head separating said suction and discharge plenums.

6. The compressor assembly of claim 5, wherein said thermoelectric device is embedded in said wall.

7. The compressor assembly of claim 1, wherein said thermoelectric device operates under the Peltier effect.

8. The compressor assembly of claim 1, wherein said suction fluid passageway includes a fluid conduit located in said housing, said compression mechanism receiving refrigerant fluid through said fluid conduit, said thermoelectric device mounted to said fluid conduit, said device receiving thermal energy from said conduit, thermal energy received by said device being converted by said device into electrical energy which is transferred from said compressor assembly.

9. The compressor assembly of claim 8, further comprising a resistor electrically connected to said thermoelectric device, said resistor thermally connected with said housing, the electrical energy received by said resistor from said thermoelectric device being transferred to said housing, whereby the thermal energy in the refrigerant fluid is transferred to said fluid conduit by convection and is conductively removed from said fluid conduit by said thermoelectric device, the electrical energy generated by said device being electrically transferred to said resistor, thermal energy generated by said resistor being conductively transferred to the inside of said housing, conducted through said housing, and removed from the outside of said housing by convection.

10. The compressor assembly of claim 8, wherein said fluid conduit includes a suction muffler, said thermoelectric device is mounted to said suction muffler.

11. The compressor assembly of claim 9, further comprising a heat sink mounted to said housing in alignment with said resistor.

12. The compressor assembly of claim 1, wherein said thermoelectric device operates under the Seebeck effect.

13. A compressor assembly, comprising:

a housing;

a compression mechanism disposed in said housing, said compression mechanism having a head which has a suction plenum and a discharge plenum defined therein; and a thermoelectric device mounted in thermal communication with the refrigerant fluid in said suction plenum and said discharge plenum, said thermoelectric device being provided with electrical power, said device conductively receiving thermal energy from said suction plenum, whereby the thermal energy is transferred to refrigerant fluid in said discharge plenum by convection.

14. The compressor assembly of claim 13, further comprising a wall formed in said cylinder head, said wall separating said suction and discharge plenums.

15. The compressor assembly of claim 14, wherein said thermoelectric device is embedded in said wall.

16. The compressor assembly of claim 13, wherein said thermoelectric device operates under the Peltier effect.

17. A compressor assembly, comprising:

a thermally conductive housing;

a compression mechanism disposed in said housing;

a fluid conduit located in said housing, said compression mechanism receiving refrigerant fluid through said fluid conduit;

a thermoelectric device mounted to said fluid conduit, said thermoelectric device in thermal communication with the refrigerant fluid in said fluid conduit, said device receiving thermal energy from said conduit, thermal energy received by said device being converted by said device into electrical energy; and a resistor electrically connected to said thermoelectric device, said resistor thermally connected with said housing, the electrical energy received by said resistor from said thermoelectric device being transferred to said housing, whereby the thermal energy in the refrigerant fluid is transferred to said fluid conduit by convection and is conductively removed from said fluid conduit by said thermoelectric device, the electrical energy generated by said device being electrically transferred to said resistor, thermal energy generated by said resistor being conductively transferred to the inside of said housing, conducted through said housing and removed from the outside of said housing by convection.

18. The compressor assembly of claim 17, wherein said fluid conduit includes a suction muffler.

19. The compressor assembly of claim 18, wherein said thermoelectric device is mounted to said suction muffler.

20. The compressor assembly of claim 17, further comprising a source of electrical power electrically connected to said thermoelectric device.

21. The compressor assembly of claim 17, wherein said thermoelectric device operates under the Seebeck effect.

22. The compressor assembly of claim 17, further comprising a heat sink mounted to said housing in alignment with said resistor.

* * * * *